US006739317B2

(12) United States Patent
Kellner et al.

(10) Patent No.: US 6,739,317 B2
(45) Date of Patent: May 25, 2004

(54) METHOD FOR OPERATING AN INTERNAL COMBUSTION ENGINE, IN PARTICULAR WITH DIRECT INJECTION, COMPUTER PROGRAM, CONTROL AND/OR REGULATING UNIT, AND FUEL SYSTEM FOR AN INTERNAL COMBUSTION ENGINE

(75) Inventors: Andreas Kellner, Tamm (DE); Juergen Hammer, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/214,157

(22) Filed: Aug. 8, 2002

(65) Prior Publication Data

US 2003/0034010 A1 Feb. 20, 2003

(30) Foreign Application Priority Data

Aug. 8, 2001 (DE) ..... 101 39 052

(51) Int. Cl.[7] ..... F02M 41/00
(52) U.S. Cl. ..... 123/446; 123/510; 123/198 DB
(58) Field of Search ..... 123/510, 511, 123/198 D, 198 DB, 446–7

(56) References Cited

U.S. PATENT DOCUMENTS

| | | | | |
|---|---|---|---|---|
| 4,565,170 A | * | 1/1986 | Grieshaber et al. | 123/198 DB |
| 4,633,837 A | * | 1/1987 | Babitzka et al. | 123/478 |
| 4,807,583 A | * | 2/1989 | Thornthwaite et al. | 123/198 D |
| 5,076,227 A | * | 12/1991 | Krieger | 123/198 DB |
| 5,275,207 A | * | 1/1994 | Tonhauser et al. | 123/198 DB |
| 5,295,470 A | * | 3/1994 | Straubel | 123/458 |
| 5,727,515 A | * | 3/1998 | Biester | 123/198 D |

* cited by examiner

*Primary Examiner*—Thomas N. Moulis
(74) *Attorney, Agent, or Firm*—Ronald E. Greigg

(57) ABSTRACT

In an internal combustion engine, in particular with direct injection, a first fuel pump delivers fuel from a fuel tank to a second fuel pump. This second fuel pump delivers the fuel to a fuel accumulation line. A metering unit is triggered by a control and/or regulating unit and meters the fuel quantity traveling into the inlet of the second fuel pump. In order to simplify the design of the engine and to reduce its cost, the invention proposes that during normal operation, the metering unit is closed when it is without power and that when the control and/or regulating unit is "dead", the metering unit is without power and the fuel delivery to the metering unit is cut off.

21 Claims, 2 Drawing Sheets

METHOD FOR OPERATING AN INTERNAL COMBUSTION ENGINE, IN PARTICULAR WITH DIRECT INJECTION, COMPUTER PROGRAM, CONTROL AND/OR REGULATING UNIT, AND FUEL SYSTEM FOR AN INTERNAL COMBUSTION ENGINE

BACKGROUND OF THE INVENTION

1. Field of the Invention

The invention relates to a method for operating an internal combustion engine, in particular with direct injection, in which a first fuel pump delivers fuel from a fuel tank to a second fuel pump that delivers fuel to a fuel accumulation line, and in which a metering unit is triggered by a control and/or regulating unit and meters the fuel quantity traveling into the inlet of the second fuel pump.

2. Description of the Prior Art

A method of operating an internal combustion is known from DE 199 26 308 A1, which discloses a pump apparatus for fuel, which has a main delivery pump embodied as a high-pressure pump, preceded by a presupply pump. The presupply pump is embodied as a mechanical fuel pump and delivers a fuel flow from a tank via a fuel line. The total fuel flow delivered is conveyed through the drive/crank chamber of the main delivery pump. Downstream of the drive/crank chamber, the total fuel flow is divided into a lubricating flow and a delivery flow. The lubricating flow travels via a return back to the tank. The delivery flow travels via a delivery circuit first to a metering unit and then on to the main delivery pump.

The main delivery pump is a radial piston pump driven by a camshaft. The radial piston pump feeds into a fuel accumulation line, which is also commonly referred to as a "rail". From the fuel accumulation line, the fuel travels to injection valves, which supply the fuel to combustion chambers of the engine.

It in order to be able to assure a reliable operation of injection valves, the pressure in the fuel accumulation line must not exceed a particular value. To this end, a pressure control valve is provided in the fuel accumulation line. If the fuel accumulation line is supplied with more fuel than is drawn by the injection valves, then above a particular pressure in the fuel accumulation line, this pressure control valve conveys the excess fuel out of the fuel accumulation line and returns it to the fuel tank.

One instance in which the pressure control valve is active, for example, is when the engine is being overrun while the control unit is simultaneously "dead". Here and in the following, a "dead" control unit is understood to mean that it is no longer possible for the control unit to adjust the fuel quantity traveling to the main delivery pump. This can be the case both in the event of an electrical failure of the control unit and in the event of a mechanically jammed metering unit. During such an overrunning, generally no fuel whatsoever is injected by the fuel injection valves into the combustion chambers of the engine. Without a pressure control valve, when the control unit is "dead", the pressure in the fuel accumulation line could increase sharply and lead, for example, to an unwanted entry of fuel into the combustion chambers.

OBJECT AND SUMMARY OF THE INVENTION

The object of the current invention is to modify a method of the type mentioned above so that the correspondingly operated internal combustion engine and here in particular, the fuel system of the engine, can be more simply designed and produced at a lower cost.

This object is attained with a method of the type mentioned above in that during normal operation, the metering unit is closed when it is without power and that when the control and/or regulating unit is "dead", the metering unit is without power and the fuel delivery to the metering unit is cut off.

The method according to the invention has the advantage that the internal combustion engine operated with it no longer requires a pressure control valve in the fuel accumulation line. Eliminating the pressure relief valve or pressure control valve in the fuel accumulation line simplifies the design of the engine and allows it to be produced at a lower cost.

An excessive increase of pressure in the fuel accumulation line and a resulting unwanted entry of fuel into the combustion chambers, for example during overrunning of the engine, is instead prevented by the method according to the invention by virtue of the fact that the fuel supply to the fuel accumulation line is reliably cut off as soon as a malfunction occurs in the control and/or regulating unit or in the metering unit. Since the powerless state of the metering unit is also its closed state, then this alone provides a highly reliable assurance that no more fuel travels to the second fuel pump. In addition, the fuel delivery to the metering unit is also cut off. This prevents the occurrence of any further delivery by means of the second fuel pump, even when the metering unit is in fact without power, but is mechanically jammed in the open state. This is based on the consideration that the pressure drop upstream of the second fuel pump and the opening pressure of the spring-loaded intake valves, which are generally used in the second fuel pump, cause this fuel pump to no be longer filled.

Another advantage of eliminating the pressure control valve lies in the fact that it is difficult or impossible to test its operational readiness. To be precise, a spring-loaded ball valve is usually used as the pressure relief valve or pressure control valve. But if the operational readiness cannot be regularly tested by the system, for example by means of a self test, then there can be no assurance in each case that the maximal permissible pressure in the fuel accumulation line will not be exceeded all the same.

With the method according to the invention, however, the operational readiness can be tested at any time. An interruption in the power supply to the metering unit, just like a discontinuation of the fuel delivery to the metering unit can be detected at any time by appropriate sensors. Consequently, the method according to the invention also increases the operational reliability of an internal combustion engine.

For example, the invention proposes that the first fuel pump be switched off when the control and/or regulating unit is "dead". This is easy to accomplish. Furthermore, an interruption of the power supply to the first fuel pump can be easily tested.

It is also possible to cut off the fuel supply to the first fuel pump by means of a shutoff valve device when the control and/or regulating unit is "dead".

This measure is particularly suitable if the first fuel pump cannot easily be switched off. This is the case, for example, with a first fuel pump that is mechanically driven, i.e. driven directly by the engine. An additional component is in fact required to execute this method, but its reliable operation can be tested at any time during the operation of the engine.

It is also advantageous to decouple a drive unit of the first fuel pump from the first fuel pump when the control and/or regulating unit is "dead". In particular, with a mechanically driven fuel pump, a clutch could be provided, which could decouple the drive unit from the pump as needed.

The invention also relates to a computer program, which is suitable for executing the method mentioned above, when it is run on a computer. It is particularly preferable if the computer program is stored in a memory, in particular a flash memory.

The invention also relates to a control and/or regulating unit for controlling and/or regulating at least one function of an internal combustion engine. With a control and/or regulating unit of this kind, it is advantageous if it is provided with a computer program of the type mentioned above.

The invention also relates to a fuel system for an internal combustion engine, in particular with direct injection, having a fuel tank, a first fuel pump that delivers from the fuel tank, and a second fuel pump, which is connected on the inlet side to the first fuel pump and is connected on the outlet side to a fuel accumulation line, and having a metering unit that meters the fuel quantity traveling into the inlet of the second fuel pump.

A fuel system of this kind is also known from DE 199 26 308 A1 and has already been explained above. In order to be able to design a fuel system of this kind more simply and produce it at a lower cost, the invention proposes that the first fuel pump be electrically driven and that the metering unit be closed when it is without power.

An electrically driven first fuel pump can be shut off in a simple manner: in particular, a malfunction of a control and/or regulating unit that controls and/or regulates the fuel system or a general power failure automatically causes the first fuel pump to be shut off and this alone cuts off the delivery in the direction of the fuel accumulation line. In order to achieve a redundancy, the metering unit is designed so that it is closed when it is without power.

Alternatively, it is possible to drive the first fuel pump mechanically and to provide a shutoff valve device between the fuel tank and the first fuel pump. This has the advantage that a very simply designed and rugged fuel pump can be used and the shutoff valve device can still cut off the fuel supply in the direction of the fuel accumulation line, for example when the engine is being overrun and a malfunction simultaneously occurs in the operation of the engine.

It is particularly advantageous if the shutoff valve device is closed when it is without power. Primarily in the event of a failure of a control and/or regulating unit, this reliably cuts off the fuel supply to the fuel accumulation line. A fuel system of this kind operates redundantly if the metering unit is also closed when it is without power.

In a preferred modification of a fuel system of the type mentioned above, the outlet side of the first fuel pump is initially connected to a drive/crank chamber of the second fuel pump and the outlet side of the drive/crank chamber of the second fuel pump is connected to an overflow line that contains an overflow valve, which adjusts the pressure in the drive/crank chamber to a particular value. This modification is based on the following concept:

When the drive means in the drive/crank chamber rotates or moves, a large amount of thermal and/or mechanical stress is generated in this region. The high fuel flow according to the invention in the vicinity of the drive/crank chamber makes a particularly good lubrication and heat dissipation possible. In particular, a positive lubrication of the drive/crank chamber is possible since the drive/crank chamber is subjected to the total fuel flow with the full delivery pressure of the first fuel pump. The fuel system according to the invention is therefore distinguished by a long service life and a reliable operation, without requiring an additional coolant circuit and/or lubricant circuit.

A particularly advantageous modification of a fuel system is the one in which a zero-delivery line branches off between the metering unit and the second fuel pump, is connected to the fuel tank or the inlet of the first fuel pump, and carries away an overflow that occurs when the metering unit is closed. Such a zero-delivery line assures that when a residual quantity of fuel nevertheless is still emerging from the outlet of the metering unit, this quantity is not forced into the fuel accumulation line, but travels back into the fuel tank via the zero-delivery line.

To that end, the opening pressure of possibly provided intake valves of the second fuel pump should be selected (preferably greater than 2 bar) so that the pressure drop due to the zero-delivery line does not cause the intake valves to open.

Placing a zero-delivery throttle in the zero-delivery line assures that during normal operation of the fuel system, i.e. when the second fuel pump is delivering fuel in the direction of the fuel accumulation line, as little fuel is possible travels back to the fuel tank through the zero-delivery line.

The metering unit can be produced in a particularly inexpensive matter if it includes an electric sliding valve. The same is true for a shutoff valve unit, which includes a magnetic on-off valve.

The fuel system according to the invention permits a pressure control valve to be eliminated. This is explicitly expressed in a modification of the fuel system according to the invention.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
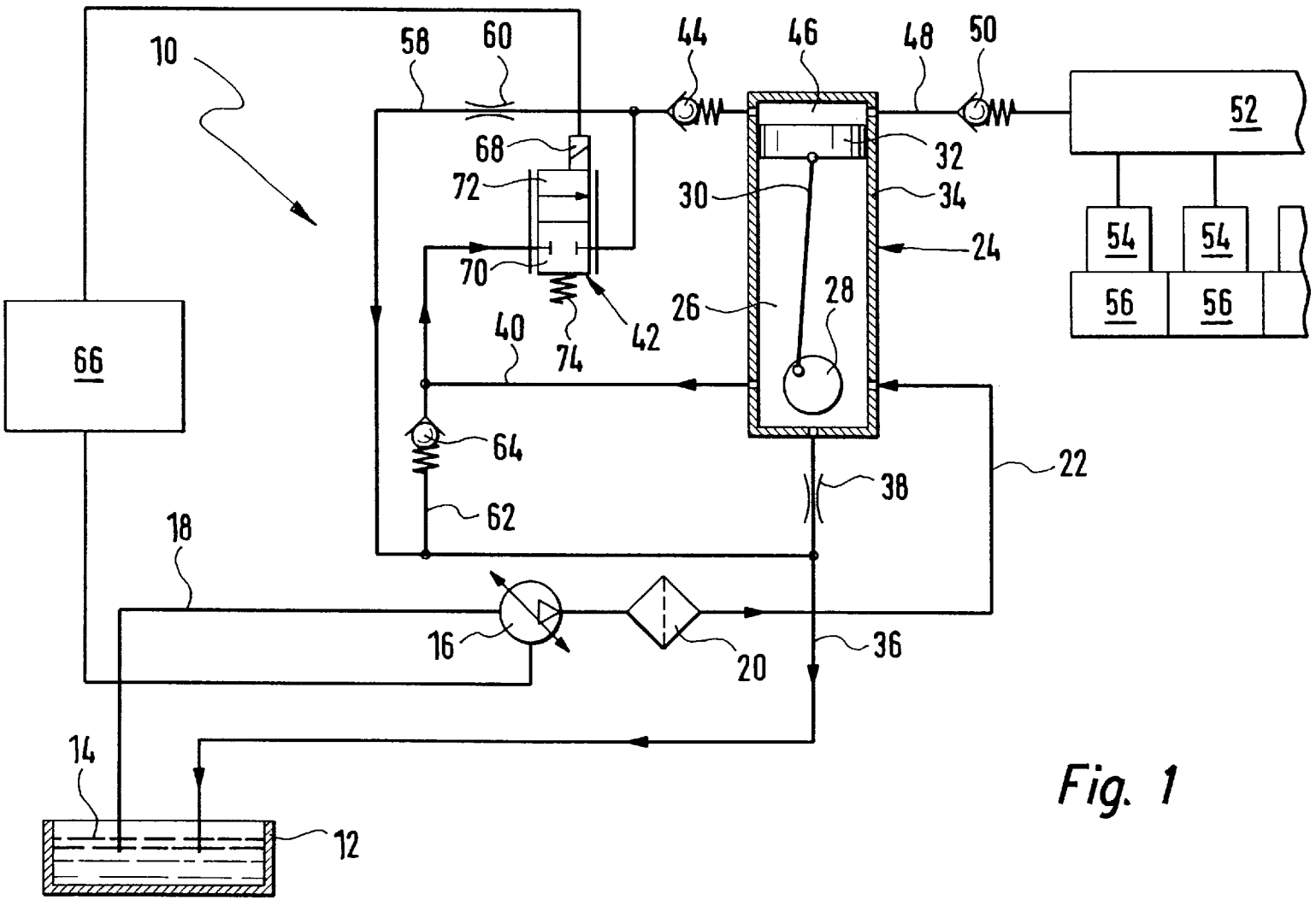
FIG. 1 shows a schematic representation of a first exemplary embodiment of a fuel system.

In FIG. 1, a fuel system is labeled as a whole with the reference numeral 10. It includes a fuel tank 12, from which fuel 14 is delivered by an electric fuel pump 16. The fuel pump 16 is connected to the fuel tank 12 by means of a fuel line 18.

A fuel line 22, containing a filter 20, leads from the electric fuel pump 16 to a mechanically driven high-pressure fuel pump 24. The fuel line 22 leads to a drive/crank chamber 26 of the high-pressure fuel pump 24. This chamber contains a crankshaft 28, which sets a piston 32 into a reciprocating motion by means of a connecting rod 30. The piston 32 is guided in a housing 34 of the high-pressure fuel pump 24.

A return line 36 leads from the drive/crank chamber 26 back to the fuel tank 12. A return throttle 38 is disposed in the return line 36. From the drive/crank chamber 26, a delivery line 40 also leads first to a metering unit 42 and from there, via a spring-loaded check valve 44 that is also referred to as an "intake valve", into a working chamber 46 of the high-pressure fuel pump 24. A working chamber 46 is defined, among other things, by the piston 32.

From the working chamber 46, a high-pressure fuel line 48 leads via a spring-loaded check valve 50 to a fuel accumulation line 52, which is commonly also referred to as the "rail". The fuel can be stored under very high pressure in the fuel accumulation line 52. The fuel accumulation line 52 is connected to high-pressure injection valves 54, which can inject the fuel under very high pressure into combustion chambers 56.

A zero-delivery line 58 branches from the section of the delivery line 40 disposed between the metering unit 42 and the check valve 44. This zero-delivery line 58 leads to the return line 36 downstream of the return throttle 38. The zero-delivery line 58 contains a zero-delivery throttle 60. In addition, a connecting line 62 branches from the section of the delivery line 40 disposed between the drive/crank chamber 26 and the metering unit 42. This connecting line 62 feeds into the zero-delivery line 58 downstream of the zero-delivery throttle 60. An overflow valve 64, which opens toward the zero-delivery line 58, is disposed in the connecting line 62.

The fuel system 10 also includes a control and regulating unit 66. On the output side, this unit is connected to magnetic actuator 68 of the metering unit 42. The metering unit 42 can be embodied as a proportional sliding valve of the kind with two end positions 70 and 72, as shown in FIG. 1, or can be a highly dynamic on-off valve with two switch positions. A spring 74 presses the metering unit 42 into the neutral position 70 in which the metering unit 42 is closed. In the actuated position 72, however, the metering unit 42 is open.

On the output side, the control and regulating unit 66 is also connected to the electric fuel pump 16. This connection can be used to influence the operation of the electric fuel pump 16. In particular, the power supply to the electric fuel pump can be interrupted.

The fuel system shown in FIG. 1 is operated according to a method, which is stored as a computer program in the control and regulating unit 66.

During normal operation, the fuel travels through the electric fuel pump 16 to the drive/crank chamber 26 of the high-pressure fuel pump 24. It is divided there into a delivery flow that travels into the delivery line 40 and a lubricating flow that travels into the return line 36. The pressure in the drive/crank chamber 26 is determined by the spring force of the overflow valve 64. It is usually approximately 3 to 4 bar.

Through the metering unit 42, the fuel travels into the working chamber 46, where, with an upward motion of the piston 32, it is compressed and displaced into the fuel accumulation line 52. The fuel quantity, which is supplied to the working chamber 46 and is pumped from there into the fuel accumulation line 52, is adjusted through a corresponding triggering of the metering valve 42 by the control and regulating unit 66.

In an exemplary embodiment that is not shown, the metering unit is embodied as a quantity control valve, which allows the inlet and the outlet of the working chamber to cancel each other out when it is without power.

In the event of a malfunction, which requires a reliable discontinuation of the fuel supply into the fuel accumulation line 52, the control and regulating unit 66 on the one hand, switches off the power to the magnetic actuator 68 and on the other, switches off the power supply to the electric fuel pump 16. Consequently, the delivery of fuel to the drive/crank chamber 26 of the high-pressure fuel pump 24 is already reduced or cut off since a presupplying of fuel is no longer taking place by means of the electric fuel pump 16. Furthermore, the spring 74 presses the metering unit 42 into the neutral position 70 so that the metering unit 42 is closed.

Any overflow that passes through even when the metering unit 42 is closed is conveyed back in the direction of the fuel tank 12 through the zero-delivery line 58. In this manner, the supply of fuel into the fuel accumulation line 52 is cut off. Since no fuel is injected into the combustion chambers 56 by the high-pressure injection valves 54 during overrunning, this measure prevents the pressure in the fuel accumulation line 52 from increasing.

Likewise, even in the event of an operational failure of the control and regulating unit 66, the delivery through the electric fuel pump 16 is automatically cut off. Furthermore, the metering unit 42 is automatically brought into the closed neutral position 70. Consequently, the delivery of fuel to the fuel accumulation line 52 is redundantly cut off in this instance as well.

Figure 2:
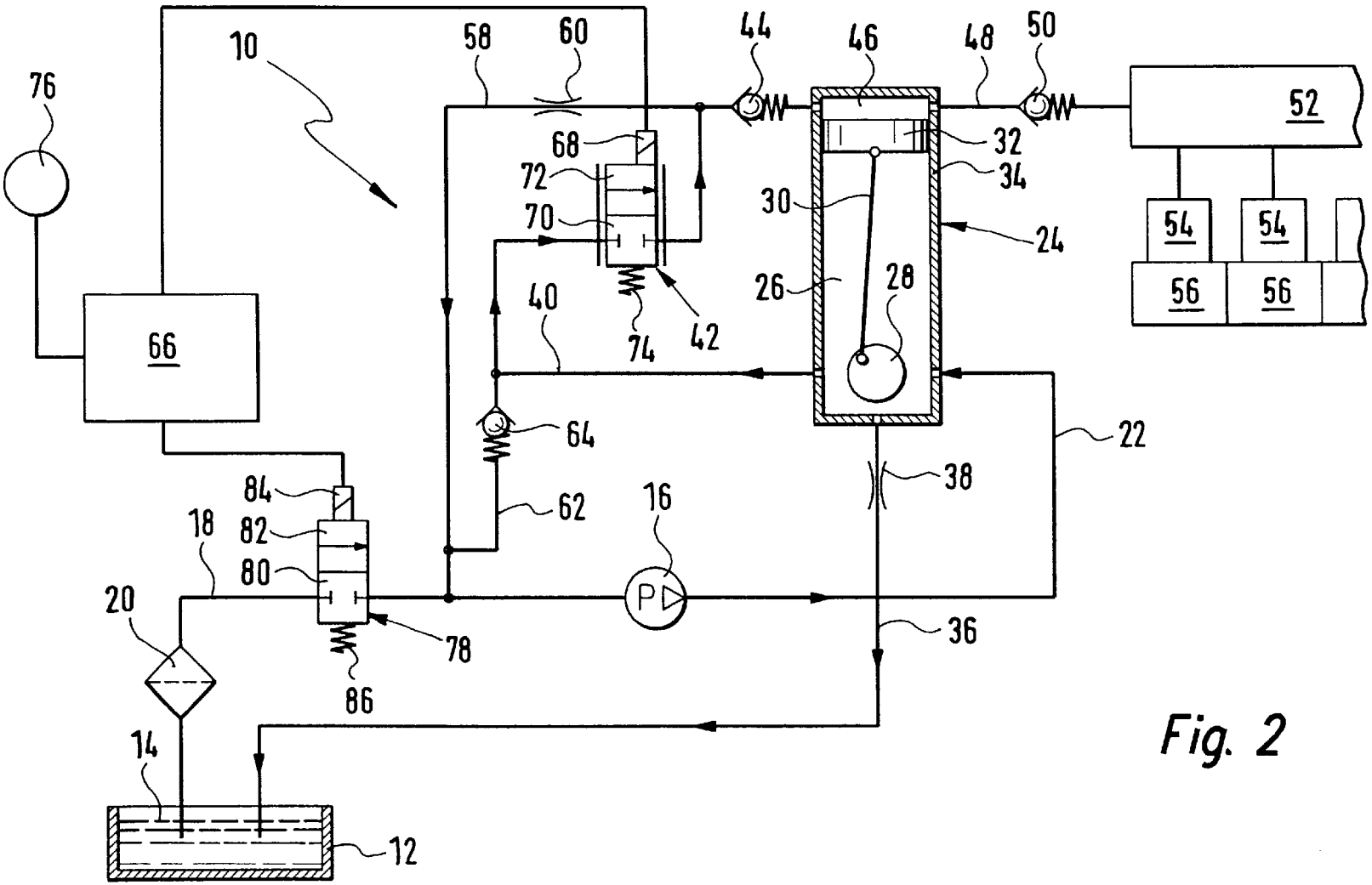
FIG. 2 shows a depiction similar to FIG. 1 of a second exemplary embodiment of a fuel system.

FIG. 2 shows a second exemplary embodiment of a fuel system 10. In FIG. 2, those elements and regions, which serve functions equivalent to elements and regions that have already been explained in connection with FIG. 1, are provided with the same reference numerals. They will not be discussed again in detail.

In contrast to the fuel system 10 shown in FIG. 1, in the fuel system 10 shown in FIG. 2, a mechanically driven fuel pump 16 is provided as the presupply pump. The drive shaft (not shown) of this fuel pump 16 is connected, for example, to the crankshaft or camshaft (not shown) of the internal combustion engine. A shutoff valve 78 is provided in the fuel line 18 between the filter 20 and the fuel pump 16. This is a 2/2-port directional-control valve with a closed neutral position 80 and an open actuated position 82. The shutoff valve 78 is actuated by means of a magnetic actuator 84 and is pressed into the closed neutral position 80 by a spring 86. The magnetic actuator 84 is triggered by the control and regulating unit 66.

Also in contrast to the first exemplary embodiment, the zero-delivery line 58 does not feed into the return line 36, but into the fuel line 18 between the shutoff valve 78 and the fuel pump 16. The connecting line 62, which contains the pressure control valve 64, feeds into the zero-delivery line 58 downstream of the zero-delivery throttle 60.

In the event of a malfunction, which requires a reliable discontinuation of the fuel delivery into the fuel accumulation line 52, in the fuel system shown in FIG. 2, the control and regulating unit 66 switches off the power to the shutoff valve 78 so that the fuel supply to the fuel pump 16 is cut off. The metering unit 42 is also closed in the manner that has already been described in connection with the first exemplary embodiment.

This also provides the redundant assurance that when no more fuel should travel from the high-pressure accumulation chamber 52, through the high-pressure injection valves 54, and into the combustion chambers 56, and there is a malfunction in the control and regulating unit 66 and/or in the metering unit 42, no fuel flows from the high-pressure fuel pump 24 into the fuel accumulation line 52. This reliably prevents the pressure in the fuel accumulation line 52 from assuming an excessive value.

At the same time, as can be seen from FIGS. 1 and 2, a separate pressure control valve, which is connected to the fuel accumulation line 52 so that it limits the pressure in this accumulation line, can be eliminated.

The foregoing relates to preferred exemplary embodiments of the invention, it being understood that other variants and embodiments thereof are possible within the spirit and scope of the invention, the latter being defined by the appended claims.

We claim:

1. A method for operating an internal combustion engine, in particular with direct injection, in which a first fuel pump (16) delivers fuel (14) from a fuel tank (12) to a second fuel pump (24) that delivers fuel (14) to a fuel accumulation line (52), and in which a metering unit (42) is triggered by a control and/or regulating unit (66) and meters the fuel quantity traveling into the inlet of the second fuel pump (24), the method comprising, closing the metering unit (42) when it is without power during normal operation, and cutting off the power to the metering unit (42) when the control and/or regulating unit (66) is "dead", whereby the fuel delivery to the metering unit (42) is cut off.

2. The method according to claim 1, wherein when the control and/or regulating unit (66) is "dead", the first fuel pump (16) is switched off.

3. The method according to claim 1, wherein when the control and/or regulating unit (66) is "dead", the fuel supply to the first fuel pump (16) is cut off by a shutoff valve device (78).

4. The method according to claim 2, wherein, when the control and/or regulating unit (66) is "dead", the fuel supply to the first fuel pump (16) is cut off by a shutoff valve device (78).

5. The method according to claim 1, wherein, when the control and/or regulating unit is "dead", a drive unit of the first fuel pump is decoupled from the first fuel pump.

6. A computer program suitable for executing the method according to claim 1, when the program is run on a computer.

7. The computer program according to claim 6, characterized in that it is stored in a memory, in particular a flash memory.

8. A control and/or regulating unit (66) for controlling and/or regulating at least one function of an internal combustion engine, comprising a computer program suitable for executing the method of claim 1 when the computer program is run on a computer.

9. A fuel system (10) for an internal combustion engine, in particular with direct injection, comprising a fuel tank (12), a first fuel pump (16) that delivers fuel from the fuel tank (12), a second fuel pump (24) connected on its inlet side to the first fuel pump (16), a fuel accumulation line (52) connected to the outlet side of the second fuel pump (24) and a metering unit (42), which meters the fuel quantity traveling into the inlet of the second fuel pump (24), the first fuel pump (16) being electrically driven and the metering unit (42) being closed when it is without power.

10. A fuel system (10) for an internal combustion engine, in particular with direct injection, comprising a fuel tank (12), a first fuel pump (16) that is mechanically driven and delivers fuel from the fuel tank (12), a second fuel pump (24) connected on its inlet side to the first fuel pump (16), a fuel accumulation line (52) connected to the outlet side of the second fuel pump (24), a metering unit (42), which meters the fuel quantity traveling into the inlet of the second fuel pump (24), and a shutoff valve device (78) connected between the fuel tank (12) and the first fuel pump (16).

11. The fuel system according to claim 10, wherein the shutoff valve device (78) is closed when it is without power.

12. The fuel system (10) according to claim 10, wherein the metering unit (42) is closed when it is without power.

13. The fuel system (10) according to claim 11, wherein the metering unit (42) is closed when it is without power.

14. The fuel system (10) according to claim 9, wherein the outlet side of the first fuel pump (16) is initially connected to a drive/crank chamber (26) of the second fuel pump (24) and the outlet side of the drive/crank chamber (26) of the second fuel pump (24) is connected to an overflow line (62) that contains an overflow valve (64), which adjusts the pressure in the drive/crank chamber (26) to a particular value.

15. The fuel system (10) according to claim 10, wherein the outlet side of the first fuel pump (16) is initially connected to a drive/crank chamber (26) of the second fuel pump (24) and the outlet side of the drive/crank chamber (26) of the second fuel pump (24) is connected to an overflow line (62) that contains an overflow valve (64), which adjusts the pressure in the drive/crank chamber (26) to a particular value.

16. The fuel system (10) according to claim 9, further comprising a zero-delivery line (58) branching off between the metering unit (42) and the second fuel pump (24), the zero-delivery line (58) being connected to the fuel tank (12) or the inlet of the first fuel pump (16) and carries away an overflow that occurs when the metering unit (42) is closed.

17. The fuel system according to claim 16, further comprising a zero-delivery throttle (60) connected in the zero-delivery line (58).

18. The fuel system (10) according to claim 9, wherein the metering unit (42) includes an electric sliding valve.

19. The fuel system (10) according to claim 10, wherein the metering unit (42) includes an electric sliding valve.

20. The fuel system (10) according to claim 10, wherein the shutoff valve device includes a magnetic on-off valve (78).

21. The fuel system (10) according to claim 9, further comprising a pressure control valve connected to the fuel accumulation line (52), the pressure control valve being operable to limit the pressure in the fuel accumulation line (52).

* * * * *